US007997820B2

(12) United States Patent
Bouix et al.

(10) Patent No.: US 7,997,820 B2
(45) Date of Patent: Aug. 16, 2011

(54) MULTI-APPLICATOR PACKAGE WITH SINGLE HANDLE

(75) Inventors: Herve F. Bouix, New York, NY (US); Jonathan T. Thayer, West Milford, NJ (US); Christophe Jacob, Rouen (FR)

(73) Assignee: ELC Management LLC, New York, NY (US)

( * ) Notice: Subject to any disclaimer, the term of this patent is extended or adjusted under 35 U.S.C. 154(b) by 394 days.

(21) Appl. No.: 12/415,160

(22) Filed: Mar. 31, 2009

(65) Prior Publication Data

US 2010/0242981 A1 Sep. 30, 2010

(51) Int. Cl.
*B43K 27/04* (2006.01)

(52) U.S. Cl. ..... 401/35; 401/34; 401/126; 401/129

(58) Field of Classification Search ..... 401/10, 401/18, 24, 34, 35, 118, 122, 126, 129
See application file for complete search history.

(56) References Cited

U.S. PATENT DOCUMENTS 4,600,328 A * 7/1986 Clements ..... 401/129
4,972,858 A 11/1990 Beck et al.
5,052,839 A * 10/1991 Pettengill ..... 401/126
5,509,742 A 4/1996 Balzarini
5,611,361 A 3/1997 Leone
6,029,675 A 2/2000 Dumler
6,120,202 A * 9/2000 Donsky ..... 401/35

FOREIGN PATENT DOCUMENTS

EP 0236133 9/1987

OTHER PUBLICATIONS

PCT International Search Report; International Application No. PCT/US2010/029315: Completion Date: Nov. 12, 2010; Date of Mailing: Nov. 12, 2010.

PCT Written Opinion of the International Searching Authority; International Application No. PCT/US2010/029315, Completion Date: Nov. 12, 2010; Date of Mailing: Nov. 12, 2010.

* cited by examiner

*Primary Examiner* — Tuan Nguyen
(74) *Attorney, Agent, or Firm* — Peter Giancana

(57) ABSTRACT

An immersion-type multi-applicator system, comprising a single container and a single handle. The container has two or more adjacent openings and each opening is capable of receiving its own applicator. Also provided is a selection mechanism that articulates the handle with exactly one applicator. The selection mechanism may be a rotary cam system, a rotary magnetic selector system, a sliding cam system, etc.

12 Claims, 6 Drawing Sheets

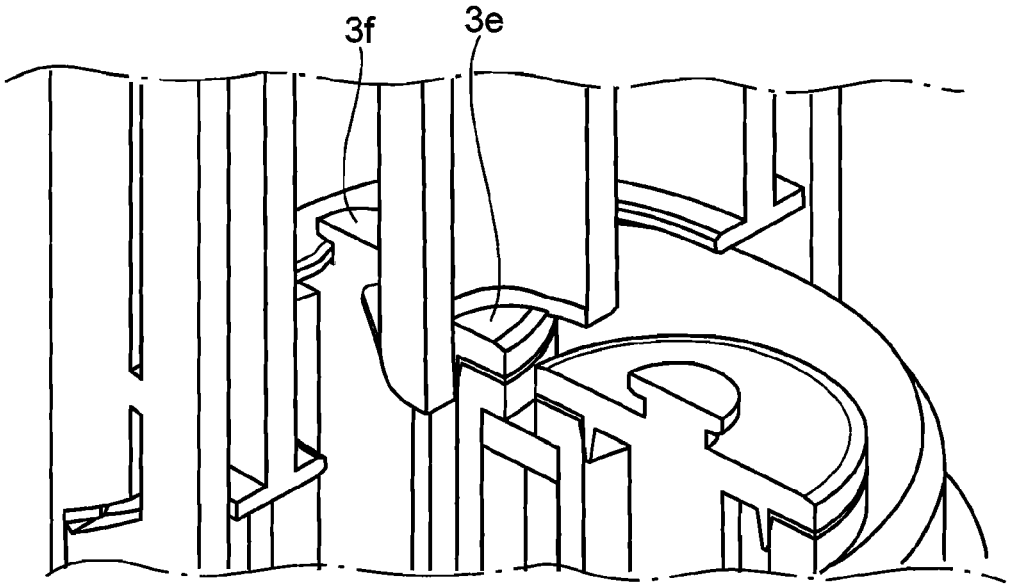
FIG. 10
FIG. 12
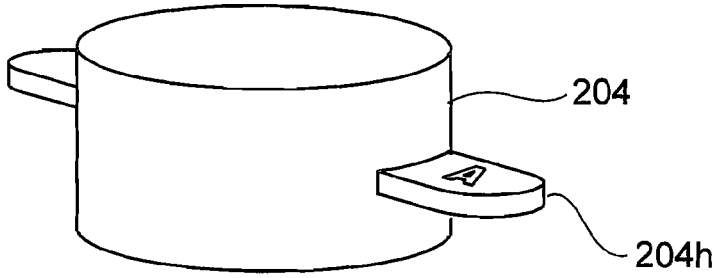
FIG. 13
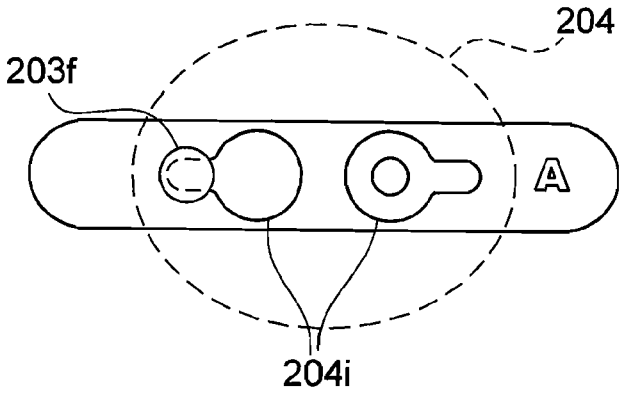

MULTI-APPLICATOR PACKAGE WITH SINGLE HANDLE

FIELD OF THE INVENTION

The present invention is in the field of cosmetic and personal care applicators. More specifically, the invention pertains to multi-applicator systems.

BACKGROUND

Product applicators are designed to deliver a quantity of product from an application surface to a target surface. By "application surface" we mean the part of the applicator that is designed to be loaded with product for transferring to a target surface, such as skin or hair. At a minimum, a product applicator comprises an application surface and structure that connects the application surface to a handle that is used to grasp and manipulate the applicator. Throughout the specification "proximal end" of an applicator refers to the portion near the handle and "distal end" refers the portion where the application surface is located. Throughout the specification, "multi-applicator" or "multi-applicator system" or "multi-applicator package" or the like, refer to a consumer product package that has at least two separate product applicators (not just two separate application surfaces, as we sometimes find on a single product applicator). Such systems, though inferior to that described herein, are known.

For example, there are systems comprising an elongated container, the container having two openings, one at either end of the container. A separate applicator is disposed in each opening. See, for example, U.S. Pat. No. 4,972,858. The container may be divided, so that each applicator is in a separate reservoir or there may be only one reservoir, which each brush enters from opposing sides (as in the U.S. Pat. No. 4,972,858). Each applicator comprises a handle that serves as a closure for its respective opening. With multiple applicators and handles protruding from different portions of the container and in different directions, the applicator system is significantly larger than a single applicator system of comparable product volume. Thus, unlike the present invention, this kind of multi-applicator system features more than one applicator handle and an oversized package. Furthermore, filling and capping a double ended container are more complicated and more costly than filling a container with a single opening and capping it with a multi-applicator according to the present invention.

Another example of an inferior multi-applicator system comprises a central, elongated, double ended applicator. A separate container is associated with each applicator. A central portion of the double ended applicator acts as two closures, one for each container. This design suffers from some of the same drawbacks as that of U.S. Pat. No. 4,972,858, namely, the applicator system is significantly larger than a single applicator system of comparable product volume. This system also requires a custom made double ended applicator and the use of two separate containers. Thus, unlike the present invention, a feature of this kind of multi-applicator system is presence of more than one container, a custom double ended applicator and an oversized package. Furthermore, securing a double ended applicator/closure to two containers is more complicated and more costly than securing the multi-applicator of the present invention to a single container.

Yet another type of inferior multi-applicator system comprises what are essentially, two complete single applicator systems attached end to end. For example, U.S. Pat. No. 5,509,742 comprises a first reservoir associated with a first applicator and handle and a second reservoir associated with a second applicator and handle. The two sub-units are articulated end to end. Here again, there are two separate reservoirs, two handle structures and a package that does not resemble the more common single applicator system, with which cosmetic product users are familiar.

The present invention will focus on the type of applicator that comprises a surface that must be immersed in a reservoir of product before the product can be applied. We call these "immersion-type applicators". In use, an immersion-type applicator is immersed in the product reservoir and then physically separated from the reservoir to deliver the product. A different type of applicator has a reservoir of product inside the applicator. Before applying product with this type of "reservoir-applicator", the product must be conveyed from the reservoir to an exit orifice that opens onto an exterior surface of the applicator. The applicator surface is never physically separated from the reservoir. One example of a this type of applicator in a multi-applicator system is a multi-color ball point pen. The pen houses multiple ink reservoirs, each attached to an application surface i.e. a ball point. Typically, a user must select a color ink by depressing one of several buttons, which causes the ball point of the selected color to extend out of the pen. Unlike the present invention, the ball point is never immersed in the reservoir and is never separated from the reservoir. In the personal care and cosmetics fields, reservoir-applicators do not have all of the advantages of a separable, "immersion-type applicator". For example, reservoir-applicators are generally less efficient at applying large amounts of product to extended surface areas; they generally hold less product for a given size package; they cannot be used with more viscous products that don't flow easily; etc. Thus, a need remains in the personal care field for a single handled, single container, immersion-type multi-applicator package.

One of the features of the present invention, that solves some of the problems in the prior art, is the placement of the openings in the container, a placement that puts the applicators in close proximity to each other and that makes the applicators parallel to each other. By "parallel applicators" we mean that all of the distal ends are side by side and all of the proximal ends are side by side where they can articulate with a single handle. U.S. Pat. No. 4,972,858 shows parallel applicators whose distal ends are side by side, but not their proximal ends. The arrangement of applicators in '858 patent could be called anti-parallel and the present invention distinguishes over this type of arrangement.

SUMMARY

The present invention is an immersion-type multi-applicator package, comprising a single container and a single handle. The container has two or more adjacent openings. Each opening is capable of receiving its own cosmetics applicator. When each applicator is disposed in the container, a portion of the applicator protrudes from the opening. Also provided is a selection mechanism that articulates a handle with the protruding portion of exactly one applicator. The handle may also serve as a closure for the container. The selection mechanism may be a rotary cam system, a rotary magnetic selector system, a sliding cam system, etc.

DESCRIPTION OF THE FIGURES

FIGS. 9 and 10 are cut away views showing the inner and outer rotary selector cams and one of the applicator stems is selected.

FIGS. 12 and 13 depict a handle that may be used in a third embodiment of the present invention, the sliding cam selector.

DETAILED DESCRIPTION

Figure 1:
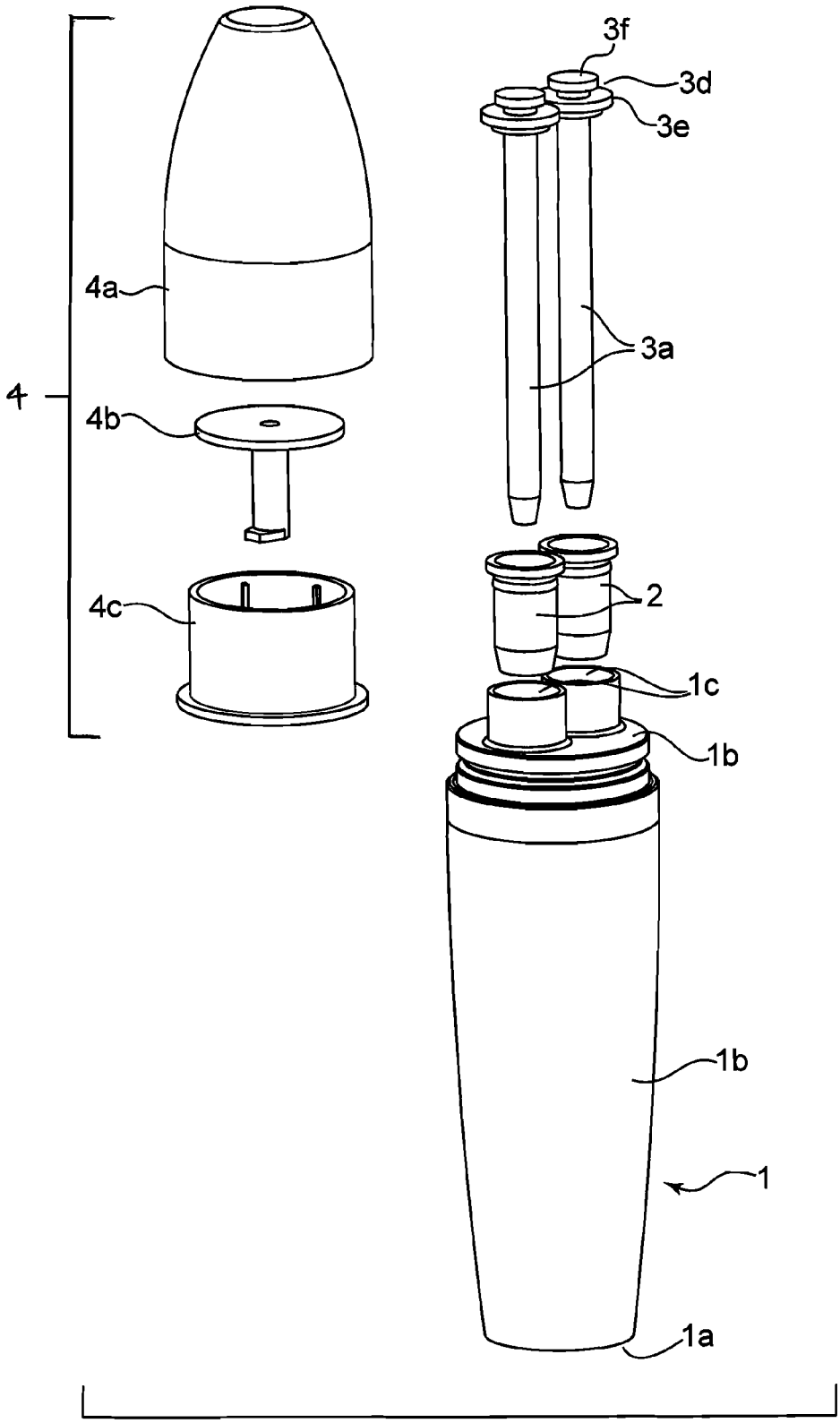
FIG. 1 is an exploded view of a multi-applicator package according to one embodiment of the present invention.
Figure 2:
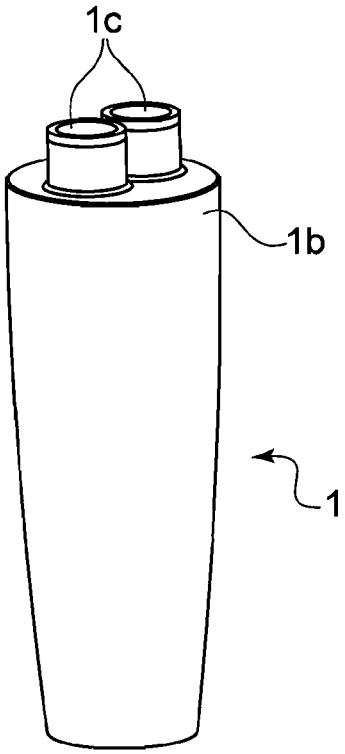
FIG. 2 depicts a container for a multi-applicator package of the present invention, molded as a single piece.
Figure 3:
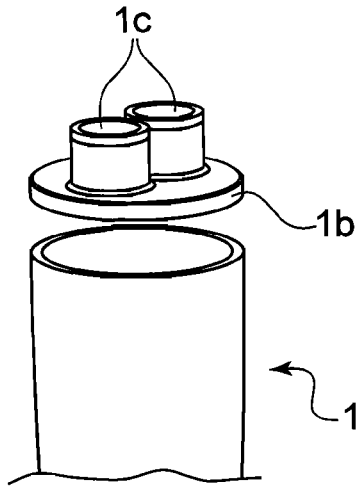
FIG. 3 depicts a container for a multi-applicator package of the present invention, molded as two pieces.
Figure 4:
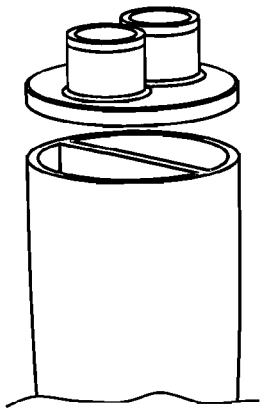
FIG. 4 depicts a container for a multi-applicator package of the present invention, interiorly divided into two reservoirs.
Figure 5:
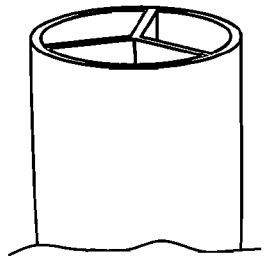
FIG. 5 depicts a container for a multi-applicator package of the present invention, interiorly divided into three reservoirs.

Referring to FIG. 1, a multi-applicator system according to the present invention comprises a container (1) for holding one or more products to be applied, and for holding two or more applicators (3). The container has a bottom end (1*a*) on which the container rests and a top end (1*b*), where two or more openings (1*c*) are located and whereon the handle (4) rests. The openings provide access to the interior of the container, which houses one or more reservoirs (1*d*). The top end of the container may be integrally molded with the main portion of the container. A one piece container is shown in FIG. 2 and may be fashioned by blow molding or any suitable known method. Alternatively, if the interior of the container is divided into multiple reservoirs, then it may be necessary to form the top end as a separate section which is later attached to the main container. A two piece container is shown in FIG. 3 and may be fashioned by injection molding or any suitable known method. Even if the container is not interiorly divided, it may still be desirable to implement the container in two pieces (to obtain a specific shape, for example). The top piece may be joined to the main container by any suitable method, including, snap fitting, welding, gluing, threading, etc. If there is only one reservoir (1*d*), then the two or more applicators (3) are immersed in the same product. If there are multiple reservoirs, then not all applicators are immersed in the same product. The manner of dividing the interior of the container into separate reservoirs is known in the art of plastic parts manufacture. For example, a plastic container with multiple compartments may be formed by injection molding the container with interior walls that extend from the bottom end to the top end of the container. FIG. 4 depicts a container with two reservoirs and FIG. 5 depicts a container with three reservoirs.

The openings (1*c*) are sized to accommodate an associated cosmetics applicator (3). The shape and dimensions of the openings need not be same, but in practice this will be common. For cosmetic and personal care applicators, the openings would not usually exceed about one inch, because the applicators that pass through the openings tend to be of this order. It may seem that if there is only one reservoir, then the container need have only one opening, but this is not the case. Each of the two or more openings (1*c*) not only provides access to the reservoir(s), it also supports an applicator stem and applicator surface disposed therein. Thus, a multi-applicator package of the present invention, requires a container with two or more openings. Optionally, but commonly, one or more of the openings may receive a wiper (or orifice reducer) (2) of the type well known in the art. The wiper uniformly distributes product on the application surface and removes excess product from the applicator. The wiper is typically dimensioned with regard to a particular applicator and a particular application effect. Therefore, each opening may have the same type or different type of wiper.

Figure 6:
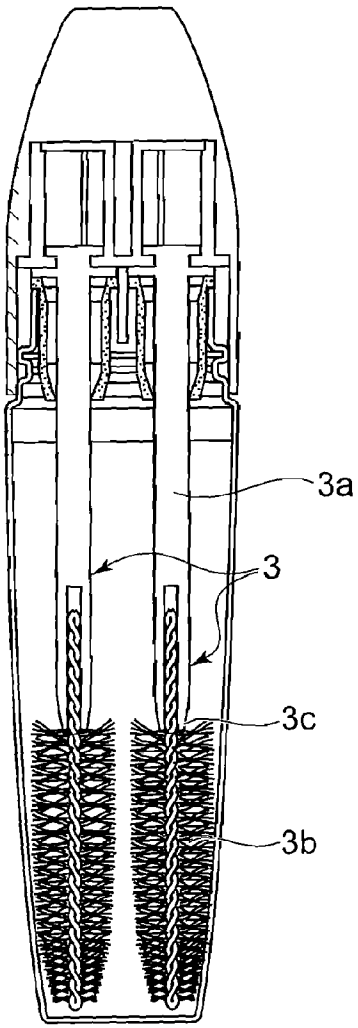
FIG. 6 is a cross sectional view of an assembled multi-applicator package of the embodiment of FIG. 1.

Referring to FIG. 6, each applicator (3) comprises a stem (3*a*) and an application surface (3*b*). The distal end (3*c*) of the stem supports the application surface, either directly or through intermediate members. In a main embodiment of the invention, both the stem and the application surface are sized to fit through the openings (1*c*) or through the wiper (2) (see FIG. 1). The stem is preferably sized so that when fully inserted into the reservoir, the application surface rests on or near the bottom of the container (1). The stem and application surface may be joined according to any known method.

The application surface (3*b*) may be any type commonly used in cosmetics and personal care for application to any part of the body. For example, the application surface may be a type suitable for mascara, foundation, hair colorant, lip products, powder products or skin treatment products. Virtually any type of applicator surface that is used or that will be used to apply topical preparations, may be utilized in the present invention. One additional type of applicator that could be used is a liquid dropper, which may not have an application surface in the sense so far discussed, but which could nevertheless be accommodated in the present invention.

When each stem (3*a*) is fully seated in the container (1), the proximal end (3*d*) of the stem (3*a*) protrudes from the top end (1*b*) of the container. The proximal end of the stem is designed to register and de-register with the selection means of the handle (4). One example of the stem and handle registering is to provide the proximal end (3*d*) of the stem with a shape that is complimentary to a feature of the handle. Another example is to provide the proximal end of the stem with a magnet or with a feature that responds to a magnetic field. In general, the relative orientation of a stem and the handle determines whether that stem and the handle form an articulation. Preferably, the handle articulates with only one stem at a time. In reference to the handle and the stems, throughout the specification the terms "articulate", "articulation" and the like, mean that the handle and stem are physically joined and form a single working unit, such that raising the handle from the container results in the articulated stem and application surface being raised out of the container, while all other applicators (3) remain in the container.

The handle (4) is the part of the device that the user normally grasps when applying product. The handle is designed to fit in the hand and to be manipulated for applying personal care and cosmetic products. As noted, the handle is designed to register and de-register with the proximal end (3*d*) of each stem (3*a*), one at a time. Thus, the placement of the openings (1*c*) in the container must be such that the single handle can interact with all of them. This precludes designs such as described above in the prior art, that have applicators on opposite sides of the container.

The handle (4) is provided with a selection mechanism. By "selection mechanism", we mean a mechanism that allows the user to register the handle with any one, and exactly one, applicator stem (3*a*), and that allows the user to change the registration as often as she likes, choosing a different applicator stem or, perhaps, no stem. A handle provided with such a selection mechanism may be referred to as an "applicator selection handle". In several embodiments described herein, the selection mechanism is rotational. That is, by rotating the handle, each stem is selected and de-selected in succession. Therefore, while the applicators are still immersed in the container (1), the handle must be free to rotate on the container, through at least some portion of 360°. The handle need only rotate far enough to successively engage each applicator, or the handle may be free to rotate without stops. The handle may be free to rotate in both directions or only one direction, but if only in one direction then the handle must be free to rotate in that direction without stops. At each position where the handle has registered with an applicator stem, it must be possible to raise the handle and applicator completely out of the container, for the consumer to use.

First Embodiment

A first embodiment of an applicator selection handle (4) is shown in exploded view in FIG. 1. In this embodiment, the handle covers the openings (1*c*) and, in the closed position, the handle rests on the container (1). In a preferred embodiment, the handle and container are concentric. They are held in contact by cooperating features that hold the handle on the container, unless overcome by a user, while still allowing the handle to rotate freely, relative to the container. For example, the inner wall of the handle may have a circumferential groove that receives a circumferential bump on the outside of the container. The feature of a handle that rotates relative to the container, while being attached to the container is relevant to the first and second embodiments disclosed herein.

Figure 7:
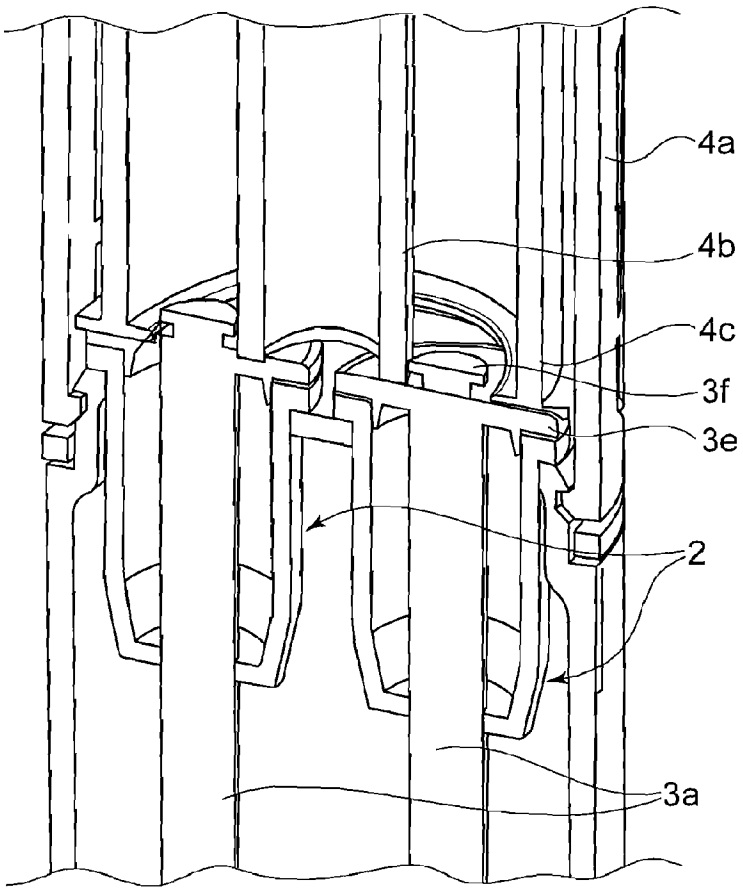
FIG. 7 is a cross sectional view showing the handle and applicator stem articulation.
Figure 8:
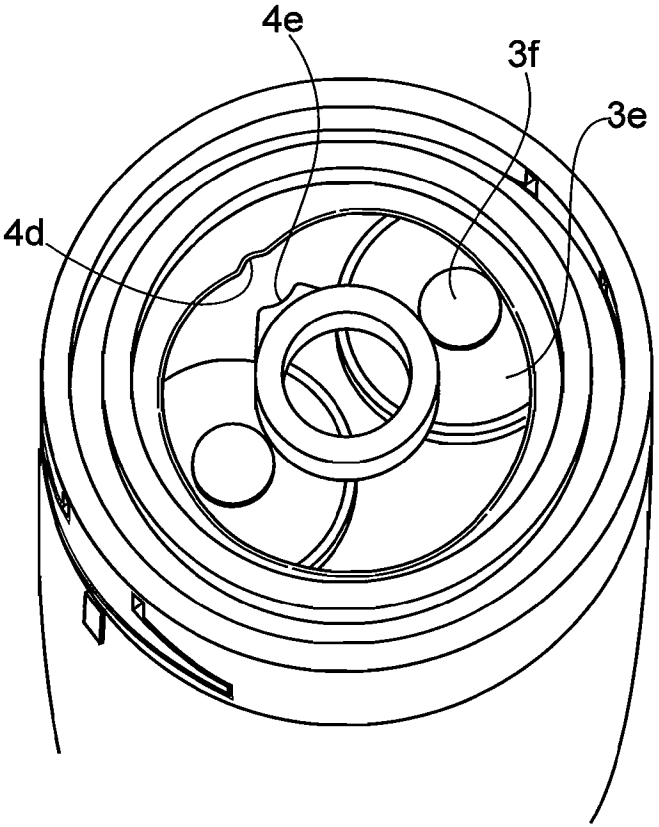
FIG. 8 is a cut away view showing the inner and outer rotary selector cams and no applicator stem is selected.

The handle comprises an inner selector cam (4*b*) and an outer selector cam (4*c*), both of which are concentrically housed in a handle housing (4*a*). The inner and outer selector cams are attached to the inside of the handle housing, so that when the handle is turned, the inner and outer selector cams also turn. More detail of this arrangement is shown in FIG. 7, where all but the lowest portion of the handle is removed in this cross sectional view. The inner selector cam depends centrally, from the interior of the handle, and has a first articulating part (4*d*). The outer selector cam is formed as a sleeve the fits into the handle interior and that has a second articulating part (4*e*). In FIG. 8, the second articulating part is formed as a bulge in the wall of the outer selector cam. The first and second articulating parts are positioned facing each other. Thus, when a user rotates the handle, as the handle is seated on the container (1), the first and second articulating parts also rotate.

Figure 9:
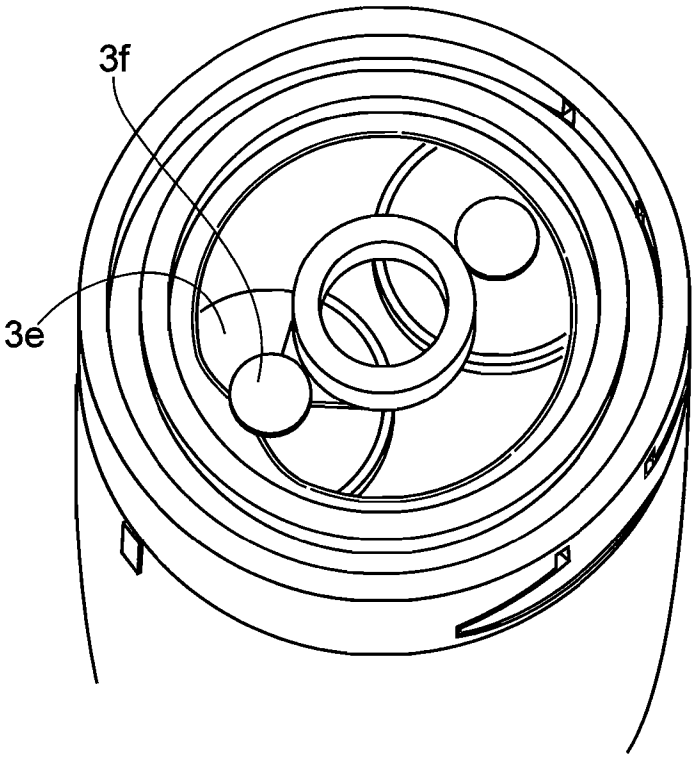

In this embodiment, the proximal end of the stem (3*d*) is provided with a shape that is complimentary to the first (4*d*) and second (4*e*) articulating parts of the inner (4*b*) and outer (4*c*) selector cams. The proximal end (3*d*) of each stem, that protrudes above the wiper, has a lower flange (3*e*) and upper flange (3*f*) (see FIG. 1). As shown, the lower flange is larger than the upper flange and is sized to fully cover the opening of the wiper, so that the lower flange can sometimes seal the wiper. The space between the upper and lower flanges is just sufficient to allow the first articulating part of the inner selector cam, and the second articulating part of the outer selector cam, to come in between the lower and the upper flange. The spacing should be such that the articulating parts fit snuggly against the stem, and form a sturdy articulation with the stem. At that point, the stem and handle are effectively one unit. This arrangement is shown in FIGS. 9 and 10. At this point, if the handle is raised off of the container, then the articulated stem will also rise out of the container, while the non-articulated stem remains in the container. When the applicator is returned to the container, the user is free to rotate the handle, which will break the articulation between the handle and the stem, by moving the first and second articulating parts out from under the flange of the stem. Rotating further, will bring the handle into articulation with the other stem.

The embodiment just described may be generalized. The exact features of the first and second articulating parts and the flange of the stem are open to variation. However, the feature of a rotating applicator selection handle that successively articulates with multiple applicator stems, via a rotating cam-type arrangement, is new.

Second Embodiment

Figure 11:
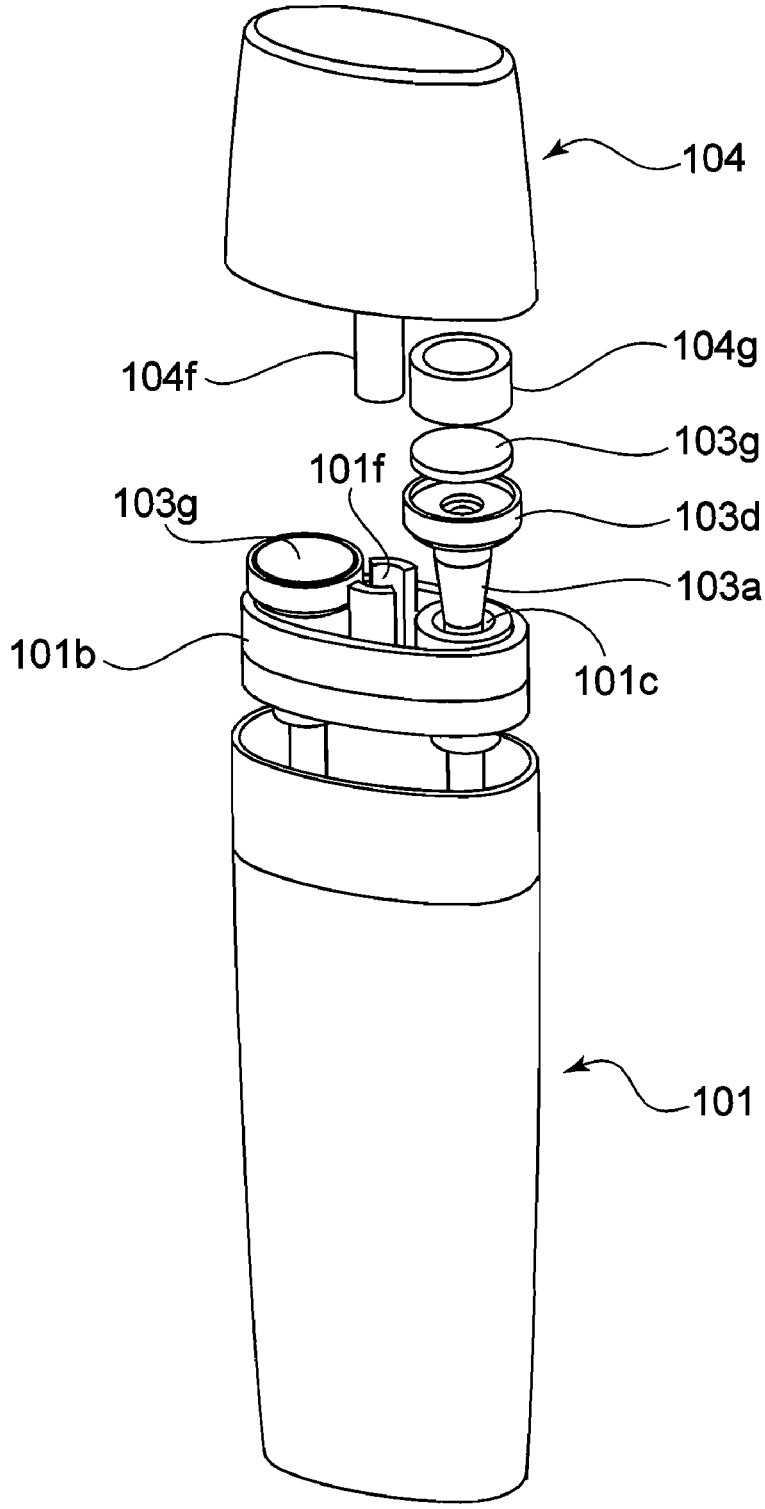
FIG. 11 is an exploded view of a multi-applicator package according to a second embodiment of the present invention, the magnetic rotary selector.

Another embodiment of the present invention is shown in FIG. 11. The main parts of this embodiment are the container (101) and the handle (104). The container comprises a reservoir (101*d*) and a top end (101*b*). In FIG. 11, the top end of the container is fashioned as separate from the rest of the container, but this is a matter of choice. If fashioned separately, then the top end and reservoir are later joined so as to form one unit. In general, the top end of the container has two or more openings (101*c*), through which the applicator stems (103*a*) pass, and a slot (101*f*) that receives the pivot (104*f*) of the handle (more on this below). In FIG. 11, the slot is implemented as two curved, vertical walls, that define a cylindrical space. The cylindrical space could have been defined by a single cylindrical wall, or any number of other designs. When each stem is fully seated in the container, the proximal end (103*d*) of the stem protrudes from the top end of the container. The proximal end of each stem is supplied with a lower magnetic material (103*g*). In FIG. 11, the top end of each stem is formed as a circular cup into which a flat cylindrical magnet or magnetic material is disposed.

The handle (104) comprises a pivot (104*f*) and an upper magnet material (104*g*). The pivot depends from the interior of the handle and is long enough to be disposed in the slot (101*f*) of the top end (101*b*) of the container. The shape of the pivot is complimentary to that of the slot, i.e. cylindrical in FIG. 11, and the pivot is sized to fit snugly, but removably, inside the slot. The upper magnetic material also depends from the interior of the handle.

The upper and lower magnetic materials must be complimentary in the sense that when the two are in close proximity, the two materials are attracted to each other. For example, the lower magnetic material may be a permanent magnet and the upper magnetic material may be paramagnetic, or vice versa. Alternatively, both the upper and lower materials may be permanent magnets, but then care must be taken to align opposite poles, so that an attractive force is created between the handle (104) and the stem (103*a*).

The handle (104) is attached to the container by inserting the pivot (104*f*) into the slot (101*f*). The handle rests on the top end (101*b*) of the container, and the handle can be rotated relative to the top end of the container. As the handle is rotated, the upper magnetic material (104*g*) successively passes over each lower magnetic material (103*g*). The clearance between the upper and lower magnetic materials is minimal. In use, the handle is rotated until the upper magnetic material comes to rest over one of the lower magnetic materials. Under the influence of a magnetic field, the lower magnetic material (and its stem) will rise to meet the upper magnetic material, and the handle and stem become articulated as a single unit. By lifting the handle off of the container (101), the articulated stem may be removed from the reservoir and used by the consumer. When the applicator is returned to the container, the user is free to rotate the handle, which will break the articulation between the handle and the stem, by separating the upper and lower magnetic materials. Rotating further, will bring the handle into articulation with the other stem. Certainly, the force of attraction between the upper and lower magnetic materials must be strong enough to maintain the connection between the handle and stem while the stem is being withdrawn from the container, used, and replaced in the container. However, the force should not be so strong, that a user has difficulty in rotating the handle.

The embodiment just described may be generalized. The exact features of the pivot (104*f*) and slot (101*f*) and of the upper (104*g*) and lower (103*g*) magnetic materials are open to variation. For example, the slot could be located on the handle and the pivot could be located on the container. However, the feature of a rotating applicator selection handle that successively articulates with multiple applicator stems, via magnetism, is new.

Third Embodiment

FIGS. 12 and 13 depict a handle that may be used in a third embodiment of the present invention, the sliding cam selector. This embodiment is convenient for two applicators, although it could be adapted for more than two.

The handle (204) comprises a flat, sliding member (204*h*) that passes through the side of the handle. A portion of the sliding member protrudes from the handle so that a user can grasp the member and slide the member into and out of the handle. FIG. 13 shows the sliding member from the top, with a top portion of the handle cut away. The sliding member has two holes (204*i*) that pass through the sliding member. Each hole comprises two parts; a narrow portion and a wide portion. As in the first embodiment described above, the proximal end of each stem protrudes above the wiper. Here, the tops of two applicator stems are visible as the stems pass through the two holes of the sliding member. Here again, each stem has a lower flange (not shown) and upper flange (203*f*). This arrangement of upper and lower flanges is the same as in FIG. 1 (3*e* and 3*f*). The lower flange is larger than the upper flange, and is sized so that it cannot fit through the wide and narrow portions of the hole of the sliding member. As above, the lower flange may be used to seal the wiper. The upper flange is sized to be able to fit through the wide portion of the hole in the sliding member, but not through the narrow portion.

The space between the upper and lower flanges is just sufficient to allow the sliding member to come in between the lower and the upper flange. The spacing should be such that the sliding member fits snuggly against the stem, and forms a sturdy articulation with the stem. The positioning of the holes (204*i*) in the sliding member (204*h*) is such that when the narrow portion of one hole is disposed between the upper and lower flange of one applicator stem (on the left in FIG. 13), then the upper flange of the other applicator stem is positioned over the wide portion of the other hole (on the right in FIG. 13). As shown in FIG. 13, the stem on the left and the handle (204) are articulated and effectively one unit. The stem on the right is disconnected from the handle i.e. not articulated with the handle.

At this point, if the handle (204) is raised off of the container, then the articulated stem will also rise out of the container, while the non-articulated stem remains in the container. When the applicator is returned to the container, the user is free to slide the sliding member, which will break the articulation between the handle and the stem, by moving the sliding member out from under the flange of the stem. Sliding further, will bring the handle into articulation with the other stem.

Optionally, the sliding member may protrude from only one side of the handle or it may protrude from either side, as it slides from side to side. If the sliding member protrudes from both sides of the handle, that may give to the user a more clear indication of which applicator is currently selected.

Additional Features

In all of the foregoing discussion, the applicator has been depicted as comprising a surface that must be immersed in a reservoir of product before the product can be applied. In principle, however, the application surface may be the product itself. For example, a solid or semi-solid stick product could be disposed within the container, depending from the distal end of a rod. The proximal end of the rod is substantially like that of the applicator stems described above. For example, a lipstick holder cup may be attached to the distal end of a rod, and a lipstick may be disposed in the holder cup. Several such lipsticks could be disposed in a single container, and a single handle with a selection mechanism could articulate with exactly one chosen rod, to lift one lipstick from the container, as described herein. At this point, we distinguish a reservoir that is filled with a free or loose product and a reservoir that houses a product attached to the end of a rod. The former requires an immersion-type applicator to go in and remove product from the reservoir. The later does not.

Optionally, one or more of the applicators may not be an applicator per se, but rather a cosmetic tool or grooming tool that does not apply product. Such a tool may be attached to the distal end of a rod and could be disposed in an empty reservoir. The proximal end of the rod is substantially like that of the applicator stems described above. The tools may be for example combs (hair, lashes, eyebrows, etc), brushes (hair, teeth), files, tweezers, clippers etc. Clearly, many other auxiliary implements or devices that one may deem useful, can take the place of one or more of the applicators proper.

In any of the embodiments of the present invention, means may be provided to inform a user as to which applicator is currently selected or if no applicator is selected. Such means may simply comprise markings on the exterior of the handle. For example, an arrow on the handle may successively point to portions of text on the container, as the handle is rotated from applicator to applicator. Also, a tactile and/or auditory clue may be given to the user by use of detents.

In any of the foregoing embodiments, the handle may be designed as a cap or closure of the container. The handle may be provided with means of attaching to the container, to seal the container when not in use. For example, the handle may friction fit onto a shoulder of the container. Any well known method may be employed, so long as it does not interfere with the selection and registering means of the handle. Alternatively, an overcap or closure that is separate from the handle may be provided.

The present invention is an immersion-type multi-applicator package, comprising a single container and a single handle. Associated with the single handle is a selection mechanism, that allows a user to articulate the handle with exactly one of any of the applicators, and that allows the user to change the articulation at will. The multi-applicator package described herein, does not suffer from many of the disadvantages of the prior art. For example, in terms of height, the applicator system of the present invention is not significantly larger than a single applicator system of comparable product volume. This is unlike containers that have multiple applicators and multiple handles protruding from different portions of the container, in different directions (U.S. Pat. No.

4,972,858); and it is unlike double ended applicators that have a separate container protruding from each end of the applicator; and it is unlike those multi-applicator systems that are essentially, two complete single applicator systems attached end to end (U.S. Pat. No. 5,509,742).

Also, the multi-applicator package of the present invention can be filled and capped in a conventional manner, unlike the package of U.S. Pat. No. 4,972,858, and unlike double ended applicator systems, where filling and capping are more complicated and more costly. To fill one of these packages, a first opening must be aligned with a fill nozzle, after filling that opening must be capped because the package is going to be inverted or partially inverted; after capping the package must be re-oriented in space to line up the next opening with the fill nozzle, etc. In the present invention, all openings are adjacent and located at the top of the package. The package does not have to be re-oriented in space to fill and all reservoirs may be filled before capping. Furthermore, the present invention does not require a custom-made double-ended applicator, nor does it require the use of two custom containers that can be mated (i.e. screw threaded) to each other end to end, and all of the added cost and complexity of filling and capping such a package. The present invention, requires only one container and only one handle, unlike the prior art. Unlike the prior art, the present invention resembles the single applicator systems familiar to users.

As described herein, the applicator selection handle is unique in the field of personal care and cosmetics consumer goods. A number of problems with the prior art are simultaneously overcome by the present invention. It was unexpected that a single design could address the issues of oversized package, costly filling and capping, costly requirements for custom made parts and lack of consumer familiarity.

The invention claimed is:

1. An immersion-type, multi-applicator package, comprising:

a container having two or more openings;

at least two applicators disposed in the two or more openings, each applicator comprising a stem and an application surface, such that a portion of each stem protrudes from the opening in which it is disposed;

a handle attached to the container, comprising a selection mechanism that allows a user to articulate the handle with exactly one of any of the protruding portions, and that allows the user to change the articulation at will, by rotating the handle relative to the container.

2. The package of claim 1 wherein the protruding portion of each stem comprises spaced apart flanges and the handle comprises first and second articulating parts that fit between the spaced apart flanges to create an articulation between the handle and the applicator.

3. The package of claim 1 wherein the protruding portion of each stem comprises a lower magnetic material and the handle comprises an upper magnetic material that attracts the lower magnetic material to create an articulation between the handle and the applicator.

4. The package of claim 1, wherein the two or more openings of the container provide access to one or more reservoirs inside the container.

5. The package of claim 4 wherein one or more of the reservoirs contain a loose cosmetic or personal care product.

6. The package of claim 1 wherein the container comprises at least one opening in which is disposed a rod attached to a solid or semi-solid cosmetic or personal care product, such that a portion of the rod protrudes from the opening in which it is disposed.

7. The package of claim 1 wherein the container comprises at least one opening in which is disposed a rod attached to a grooming tool selected from the group consisting of combs, hair brushes, tooth brushes, files, tweezers, and clippers.

8. A method of using an immersion-type, multi-applicator package, comprising the steps of:

providing a multi-applicator package according to claim 1;

rotating the handle relative to the container until one of the applicators is articulated with the handle;

moving the handle away from the container so that the articulated applicator is removed from its opening of the container;

returning the articulated applicator to the container; and rotating the handle relative to the container to break the articulation of the handle and articulated applicator.

9. An immersion-type, multi-applicator package, comprising:

a container having two openings;

two applicators disposed in the two openings, each applicator comprising a stem and an application surface, such that a portion of each stem protrudes from the opening in which it is disposed;

a handle attached to the container, comprising a selection mechanism that allows a user to articulate the handle with exactly one of the two protruding portions, and that allows the user to change the articulation at will, by sliding a portion of the handle relative to the container.

10. The package of claim 9 wherein the handle comprises a sliding member that protrudes from the side of the handle and that is able to slide into and out of the handle.

11. The package of claim 10 wherein:

the sliding member comprises one hole for each applicator, each hole having a narrow portion and a wide portion;

the protruding portion of each stem comprises an upper flange and a lower flange spaced apart, such that:

for each stem, one flange is disposed on either side of the sliding member;

the lower flange cannot fit through the hole of the sliding member; and the upper flange is able to fit through the wide portion of the hole in the sliding member, but not through the narrow portion; and wherein the positioning of the holes in the sliding member is such that when the narrow portion of one hole is disposed between the upper and lower flange of one applicator stem, then the upper flange of the other applicator stems is positioned over the wide portion of the other hole in the sliding member.

12. A method of using an immersion-type, multi-applicator package, comprising the steps of:

providing a multi-applicator package according to claim 10;

sliding the sliding member relative to the container until one of the applicators is articulated with the handle;

moving the handle away from the container so that the articulated applicator is removed from its opening of the container;

returning the articulated applicator to the container; and sliding the sliding member relative to the container to break the articulation of the handle and articulated applicator.

* * * * *